US005363684A

United States Patent [19]

Thudium et al.

[11] Patent Number: 5,363,684

[45] Date of Patent: Nov. 15, 1994

[54] DEVICE FOR TRANSFERRING SHEET METAL PARTS IN A PRESS INSTALLATION

[75] Inventors: Karl Thudium, Wäschenbeuren; Andreas Dangelmayr, Ottenbach; Walter Rieger, Göppingen, all of Germany

[73] Assignee: L. Schuler GmbH, Germany

[21] Appl. No.: 147,537

[22] Filed: Nov. 5, 1993

[30] Foreign Application Priority Data

Nov. 5, 1992 [DE] Germany ..... 4237316

[51] Int. Cl.[5] ..... B21D 43/05

[52] U.S. Cl. ..... 72/405; 414/750

[58] Field of Search ..... 72/405; 414/749, 750, 414/752; 198/621

[56] References Cited

U.S. PATENT DOCUMENTS 4,995,505 2/1991 Takahashi ..... 72/405
5,159,827 11/1992 Shiraishi ..... 72/405

FOREIGN PATENT DOCUMENTS 163037 9/1984 Japan ..... 72/405
273530 11/1988 Japan ..... 72/405
245929 10/1989 Japan ..... 72/405
295620 12/1990 Japan ..... 72/405

*Primary Examiner*—Daniel C. Crane
*Attorney, Agent, or Firm*—Evenson, McKeown, Edwards & Lenahan

[57] ABSTRACT

In order to reduce the transfer times of sheet metal parts in a press installation, the fastening point of the devices holding the sheet metal parts can be adjusted on a running carriage, which can be driven horizontally in a running rail, in the direction of the travel movement by an adjusting device.

4 Claims, 2 Drawing Sheets

Fig. 1
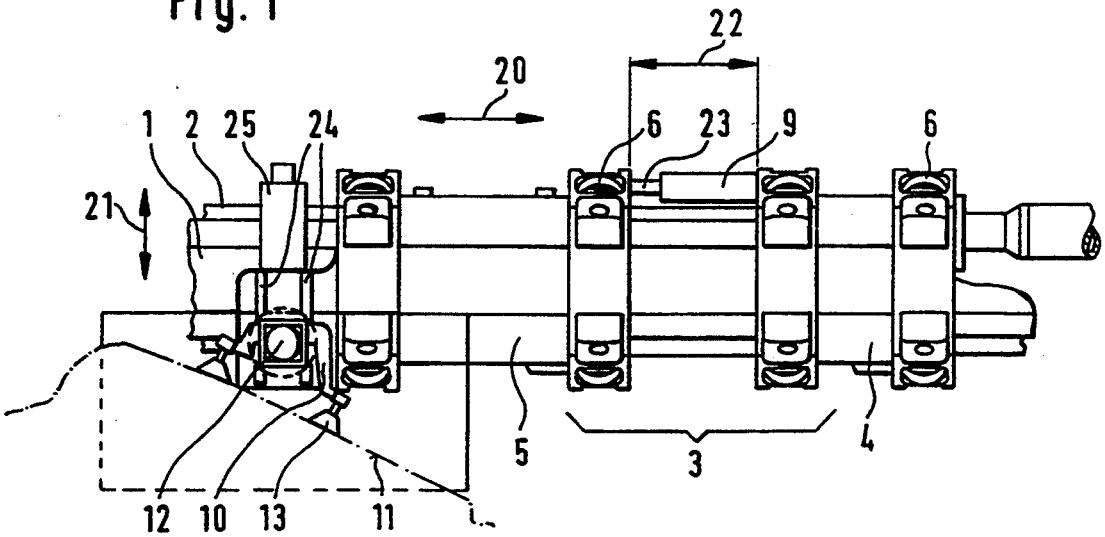
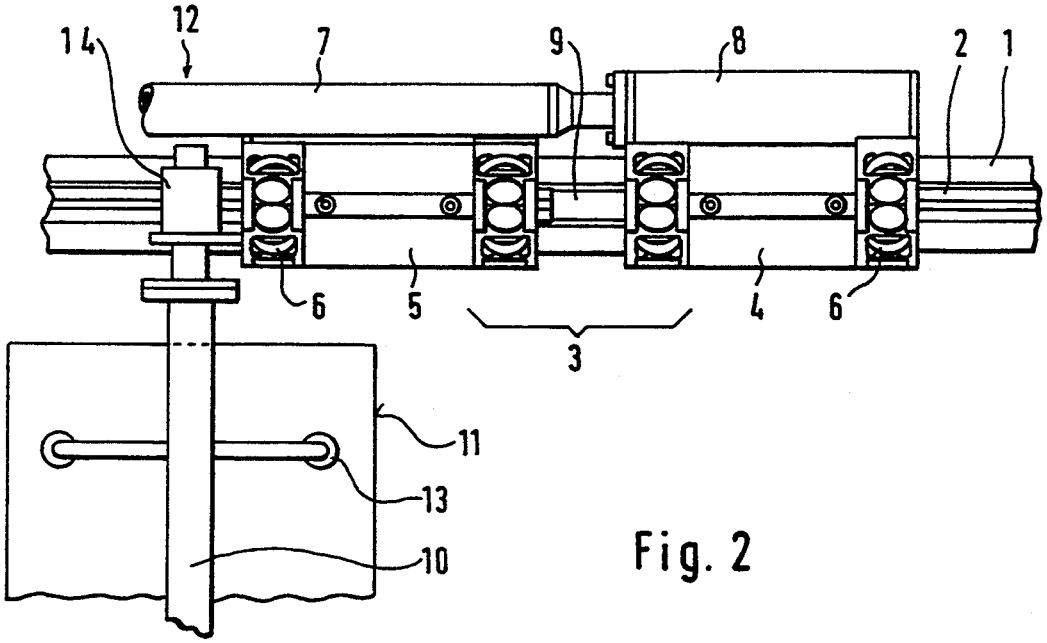
Fig. 2

DEVICE FOR TRANSFERRING SHEET METAL PARTS IN A PRESS INSTALLATION

BACKGROUND AND SUMMARY OF THE INVENTION

The present invention relates to a device for the transfer of sheet metal parts in a press installation, with holding devices which hold and move the sheet metal parts being fastened as traverses on running carriages, which are movable horizontally by drives on rails and are liftable and lowerable with these rails.

Due to the increasing sizes of the sheet metal parts to be machined or larger batch sizes, transfer speeds of the sheet metal parts in the press installations, from the inserting or orientation stage through the press installation to the workpiece delivery, become continuously higher. In the past, this has resulted in transfer devices of lower masses. In addition, when the sheet metal part is rotated, because of the necessity of the removal from the tool and/or for positioning the sheet metal part in the tool that follows, a center fault of the sheet metal part will occur.

In German Patent Document DE 41 04 810 A1, a device is described for the transfer of sheet metal parts in a press installation in which the sheet metal parts, during the movement from a machining stage to a depositing device and from this depositing device into the machining stage which follows, are rotated for positioning the sheet metal parts in the tools. For this purpose, the device has traverses which are provided with suction devices. The traverses are fastened on an end face in pivot bearings of rail-guided running carriages. The travelling movements of the running carriages are press-controlled by way of a transport linkage. Correspondingly, the rails can be lifted and lowered.

Furthermore, U.S. Pat. No. 4,625,540 describes a transfer device with a frame which is guided in liftable and lowerable running rails and can be moved horizontally. On this frame, traverses can additionally be moved via adjusting devices in such a manner that, during the periods when the slide moves down, they are guided without the sheet metal part into an area between the slide and the tool for a short stoppage.

In the German Patent Document DE 39 31 081 A1, an intermediate depositing device is described for a depositing station between two machining stages of a press. The intermediate depositing device has templates for the support of the sheet metal parts which can be adjusted by adjusting devices and movement deflecting devices in their height, distance and oblique position for another sheet metal part or to a machining stage which follows. The error which is caused by the swivelling of the sheet metal part can be adjusted by the adjusting devices for the horizontal and the vertical movement of the templates.

In view of this prior art, an object of the present invention is to arrange the holding devices on the running carriages so that they can be displaced relative to them in order to, on the one hand, reduce the transfer path of the individual running carriage and on the other hand, compensate the correcting movements which are required as a result of the rotation of the sheet metal parts and which may differ from one running carriage to the next.

This and other objects are achieved by the present invention which provides a device for the transfer of sheet metal parts in a press installation comprising liftable and lowerable rails, running carriages mounted on the rails to be horizontally movable on the rails and liftable and lowerable with the rails, drives coupled to the running carriages that move the running carriages horizontally on the rails, and traverses serving as holding devices which hold and move the sheet metal parts and are fastened on the running carriages at a fastening point that is adjustable at least in a direction of the travelling movement of the running carriage.

By the adding of the adjusting movements of two moving drives of the traverse, short movements of the transport linkage can be achieved while the transfer movement is the same and the number of transfer movements is increased. When the number of transfer movements is the same, larger transfer movement lengths can be achieved.

Another important advantage of the invention is the fact that, when additional moving devices are utilized, correcting movements can be compensated, for example, those which become necessary because of the rotation of the traverse.

Other objects, advantages and novel features of the present invention will become apparent from the following detailed description of the invention when considered in conjunction with the accompanying drawings.

BRIEF DESCRIPTION OF THE DRAWINGS

FIG. 1 is a side view of a running carriage with the device constructed according to a first embodiment of the present invention;

FIG. 2 is a top view of the embodiment according to FIG. 1;

DETAILED DESCRIPTION OF THE DRAWINGS

Figure 3:
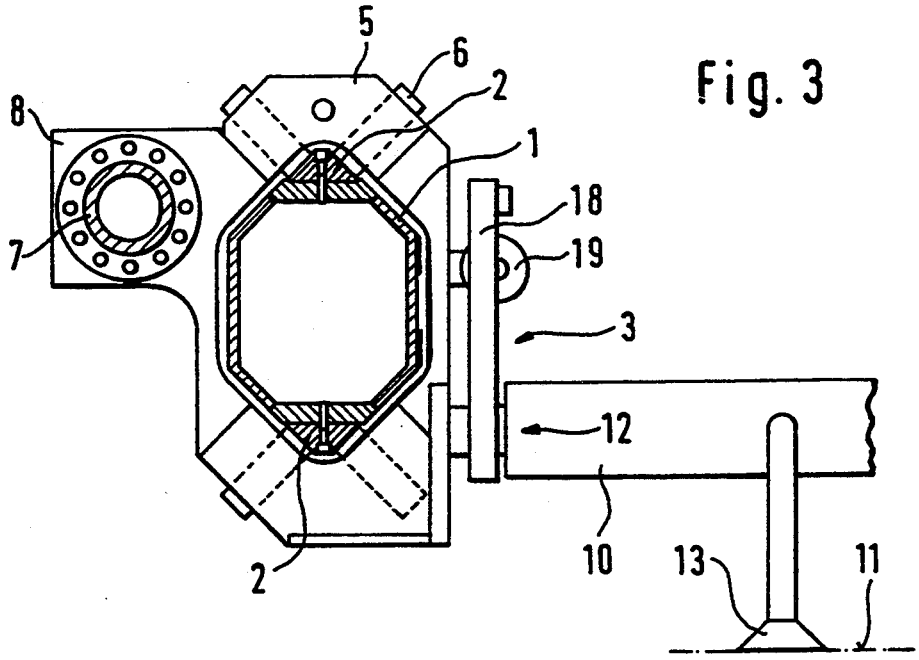
FIG. 3 is a sectional view taken along line III—III of the section according to FIG. 4.

FIG. 1 illustrates a running rail 1 which can be lifted and lowered in a press, a transfer press or similar press installation in the direction of the double arrow 21. The running rail 1 extends in the direction of the transfer movement 20 of sheet metal parts 11 through the press. As a rule, two running rails exist of the type of which one extends in front of and the second extends behind the slide and the tool. Respective running carriages 3 can be movably disposed on the two running rails 1 in the number of required traverses 10 and are mechanically or electrically driven by the press drive.

The running rail 1 is provided with running surfaces 2 on which roll the rollers 6 of a running carriage which, as a whole, has the reference number 3. The illustrated running carriage 3 is divided in two parts in its basic construction, having a first carriage part 4 and a second carriage part 5. As illustrated in FIG. 2, via a runner 8, a transport linkage 7 is fastened to the carriage part 4 and is acted upon by the press drive, via which transport linkage 7 the running carriage 3 can be moved horizontally on the running rail 1.

The carriage part 5 has a pivot 12 which is used as a fastening point for a traverse 10 which is rotatably disposed in this case. This traverse 10 is equipped with suction devices 13 or similar devices for the holding of sheet metal parts 11 during the removal of the parts 11 from a depiling station or the tool for the transfer and depositing into the following station. Between carriage part 4 and carriage part 5, a linear motor, a pressure cylinder or similar first adjusting device 9 is mounted for providing a relative movement between the carriage parts 4 and 5. Thus carriage part 5 is connected to carriage part 4 and moves like that carriage part 4 because of the operation of the press. Furthermore, an additional movement is possible due to the adjustability of the adjusting device 9. When the spindle or piston 23 of the adjusting device 9, during the transfer movement of the running carriage 3, is in an at least partially moved-out position, a reduction of the overall movement of the running carriage 3 and of the carriage part 4 is possible when the adjusting device 9 is acted upon.

The rotational adjustment of the traverse 10 takes place via a torque motor 14 which is flanged to carriage part 5. The traverse 10, the torque motor 14 and thus the fastening point 12 are guided in vertical rails 24 and can be lifted and lowered on these rails by second adjusting devices 25.

Figure 4:
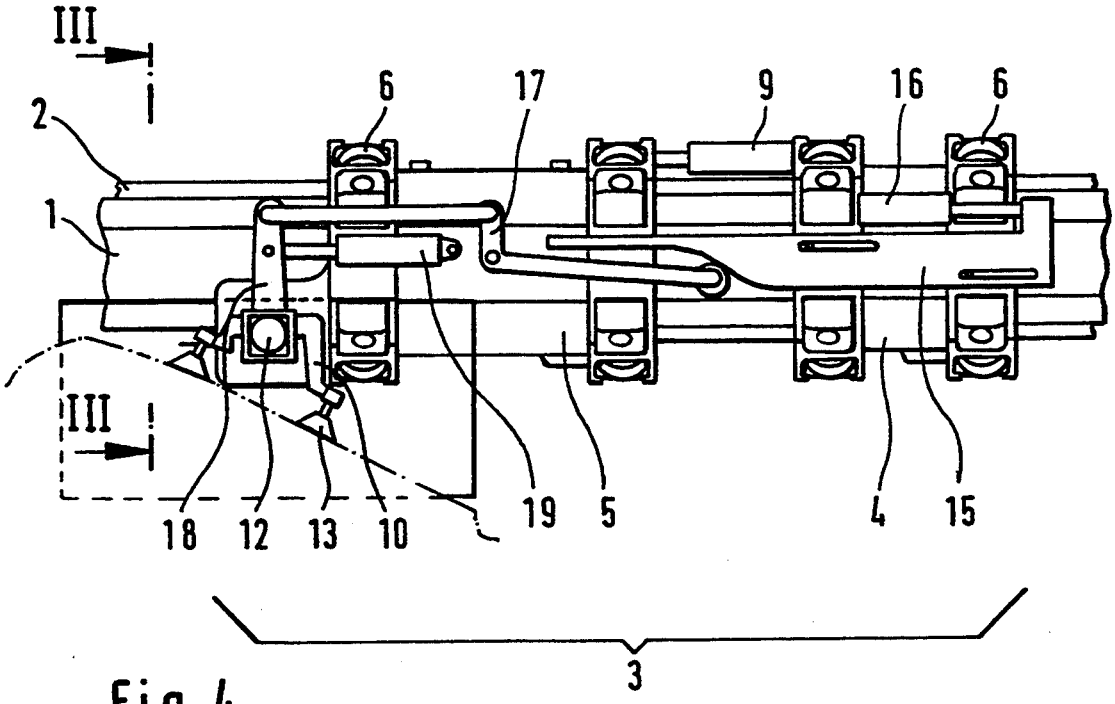
FIG. 4 is a view of a running carriage with the device according to a second embodiment of the present invention.

In FIGS. 3 and 4, identical parts have the same reference numbers.

In addition to the multipart characteristic of the running carriage 3, FIG. 2 shows the acting-upon of the carriage part 4 by the transport linkage 7 and the arrangement of the torque motor 14. The traverse 10 is illustrated in a broken-off manner. The end piece of the traverse 10 on the other side is rotatably disposed in a running carriage which is constructed identically and can be moved in a second running rail. The sectional representation of FIG. 3 illustrates the components of the running carriage, in this case, of carriage part 5.

FIG. 4 shows an embodiment having a carriage construction identical to the one described above. The rotating movement of the traverse 10 fastened in pivot 12 takes place by means of a cam follower lever 17, which is placed against a cam 15 which can be displaced on the carriage part 4 by a linear adjusting device 16, and by means of an angle lever 18 with the pivot in the fastening point 12. The cam follower lever 17 is held against the cam 15 by an air cylinder 19. The cam 15 can be adjusted by an adjusting device 16 guided longitudinally for a rotation of the traverse according to the point in time.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A device for the transfer of sheet metal parts in a press installation comprising:

liftable and lowerable rails;

running carriages horizontally movably mounted on the rails and liftable and lowerable with the rails, the running carriages having first and second carriage parts that are movably connected to one another and are both directly mounted on the rails;

drives coupled to the first carriage parts of the running carriages that move both of the first and second carriage parts of the running carriages together horizontally on the rails to move the sheet metal parts;

traverses serving as holding devices which hold and move the sheet metal parts and are fastened to the second carriage parts of the running carriages at a fastening point that is adjustable at least in a direction of the travelling movement of the running carriage; and an adjusting device coupled between the first and second carriage parts for adjusting the fastening point by moving the second carriage parts relative to the first carriage parts during the movement of the sheet metal parts, by an additional amount separate from the movement of both of the first and second carriage parts provided by said drives to thereby move the traverses and the sheet metal parts by said additional amount.

2. A device according to claim 1, wherein the first carriage part is acted upon by one of the drives to move the running carriage horizontally on the rail, and the second carriage part houses the fastening point for the traverse is provided between the first carriage part and the second carriage part, the adjusting device changing the distance between the first and second carriage parts.

3. A device according to claim 2, further comprising vertical rails in which the traverse is guided on at least one of the first and second carriage parts, and a further adjusting device coupled to the traverse which lifts and lowers the traverse.

4. A device according to claim 1, further comprising vertical rails in which the traverse is guided on the running carriage, and a further adjusting device coupled to the traverse which lifts and lowers the traverse.

* * * * *